US011318466B2

(12) United States Patent
Markel et al.

(10) Patent No.: US 11,318,466 B2
(45) Date of Patent: May 3, 2022

(54) MICROFLUIDIC FLUID FLOW IN A TARGET FLUID

(71) Applicant: HEWLETT-PACKARD DEVELOPMENT COMPANY, L.P., Spring, TX (US)

(72) Inventors: David P. Markel, Corvallis, OR (US); Erik D Torniainen, Corvallis, OR (US); Alexander Govyadinov, Corvallis, OR (US); Pavel Kornilovich, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 348 days.

(21) Appl. No.: 16/618,200

(22) PCT Filed: Jul. 19, 2017

(86) PCT No.: PCT/US2017/042753

§ 371 (c)(1),
(2) Date: Nov. 29, 2019

(87) PCT Pub. No.: WO2019/017927

PCT Pub. Date: Jan. 24, 2019

(65) Prior Publication Data

US 2020/0179924 A1 Jun. 11, 2020

(51) Int. Cl.
*B01L 3/00* (2006.01)

(52) U.S. Cl.
CPC ..... *B01L 3/50273* (2013.01); *B01L 3/502715* (2013.01); *B01L 2200/0621* (2013.01);
(Continued)

(58) Field of Classification Search
CPC ..... B01L 3/50273; B01L 3/502715; B01L 2200/0621; B01L 2200/10; B01L 2200/16;
(Continued)

(56) References Cited

U.S. PATENT DOCUMENTS 4,683,295 A 7/1987 Carson
6,719,682 B2 4/2004 Kellogg
(Continued)

FOREIGN PATENT DOCUMENTS

WO WO-1999067425 A2 12/1999

OTHER PUBLICATIONS

Tang, M et al., A Review of Biomedical Centrifugal Microfluidic Platforms, 2016 < www.mdpi.com/2072-666X/7/2/26/pdf >.

*Primary Examiner* — Jennifer Wecker
*Assistant Examiner* — Oyeleye Alexander Alabi
(74) *Attorney, Agent, or Firm* — Perry + Currier Inc

(57) ABSTRACT

One example includes a device that may include a heating element and a molecular binding site. The heating element may heat a fluid volume, interfaced with the heating element, in response to a voltage being applied to the heating element, the heat transforming the fluid volume from a liquid state into a vaporized state to generate fluid motion within the fluid volume. The molecular binding site may be disposed proximate to the heating element, in which a portion of the fluid volume expands when the fluid volume transforms from the liquid state into the vaporized state, the vaporized state of the fluid volume generating the fluid motion within a target fluid that is disposed within the molecular binding site.

13 Claims, 8 Drawing Sheets

(52) U.S. Cl.
CPC ..... *B01L 2200/10* (2013.01); *B01L 2200/16* (2013.01); *B01L 2300/087* (2013.01); *B01L 2300/0816* (2013.01); *B01L 2300/1827* (2013.01)

(58) Field of Classification Search
CPC ..... B01L 2300/0816; B01L 2300/087; B01L 2300/1827; B01L 2200/0678; B01L 2400/0442; B01L 7/00; F04B 17/03; F04B 19/24; F04B 19/006
See application file for complete search history.

(56) References Cited

U.S. PATENT DOCUMENTS

| | | | |
|---|---|---|---|
| 7,049,558 | B2 | 5/2006 | Baer |
| 7,060,439 | B2 | 6/2006 | Gordon et al. |
| 7,235,736 | B1 | 6/2007 | Buller |
| 8,786,396 | B2 | 7/2014 | Leung |
| 9,468,894 | B2 | 10/2016 | Clemmens et al. |
| 2003/0064507 | A1 | 4/2003 | Gallagher et al. |
| 2003/0175947 | A1 | 9/2003 | Liu et al. |
| 2004/0086872 | A1 | 5/2004 | Childers et al. |
| 2006/0128006 | A1* | 6/2006 | Gerhardt ..... B01L 3/502761 435/287.1 |
| 2015/0258545 | A1 | 9/2015 | Khuntontong et al. |

* cited by examiner

MICROFLUIDIC FLUID FLOW IN A TARGET FLUID

BACKGROUND

Microfluidic analysis is increasingly becoming used to test small samples (e.g., droplet) of fluid to determine its biological and/or chemical characteristics. Such a sample may be introduced to a fluid processing chip (e.g., integrated circuit chip) that processes the sample to determine if the sample includes various chemicals and/or biological fluid. In some instances, sample may be mixed with one or more other chemicals before analysis by the fluid processing chip.

BRIEF DESCRIPTION OF THE DRAWINGS

FIGS. 3A and 3B illustrate yet another example device for generating fluid motion within the target fluid.

DETAILED DESCRIPTION

Figure 1A:
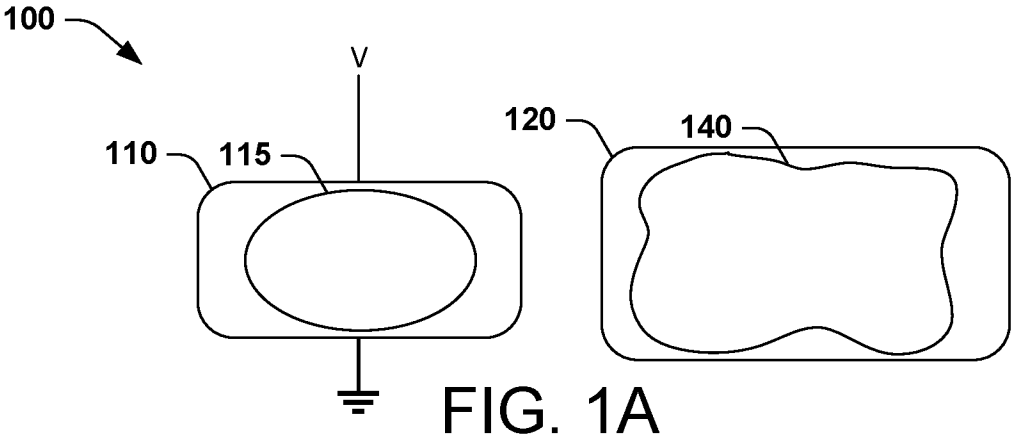
FIGS. 1A and 1B illustrate an example device for generating fluid motion within a target fluid.

The disclosure relates to micro-mixing of micro, nano and pico-liter scale volumes of fluid via a drive bubble. Examples include a device that may include a heating element and a molecular binding site. The heating element may heat a fluid volume that is interfaced with the heating element. The fluid volume may be heated in response to a voltage being applied to the heating element, with the heat transforming the fluid volume from a liquid state into a vaporized state to generate fluid motion within the fluid volume. The molecular binding site may be proximate to the heating element and may be in which a portion of the fluid volume expands when the fluid volume transforms from the liquid state into the vaporized state, the vaporized state of the fluid volume generating the fluid motion within a target fluid that is disposed within the molecular binding site. In some examples, the heating element may be a thermal ink-jetting (TIJ) resistor. In other examples, the fluid volume may include aqueous solution and the target fluid may include an analyte and a reagent.

The device may be employed with immunoassay such as utilized to analyze a binding reaction between an antibody and the analyte. Immunoassay may analyze a binding reaction between the antibody and the analyte, with a nature of this reaction varying considerably and being a factor to the development of an effective assay. Non-specific binding (NSB) may result in a background signal in absence of a target antibody. High background levels may reduce the signal-to-noise ratio of the assay limiting the assay's detection range. In competitive assay designs, sensitivity may be governed by factors that include equilibrium constant, precision of signal measurement, and a level of NSB. Consequently, variations in NSB may form a contribution to overall imprecision. Other examples include application of the device to aptamers and probes based on deoxyribonucleic acid (DNA) complementarity. The device can be utilized with any target fluid that benefits from the fluid motion generated by the device.

In micro, nano, and pico-liter scale immunoassays, viscosity and surface tension forces in biological fluids may impact distribution of the analyte (the target ELISA is detecting) and reagents. Reducing the sample size also reduces a number of molecules and has different effects on qualitative and quantitative outputs. A common problem associated with immunoassays is NSB due in part several possible causes, such as poor design, reagents, solid phase binding, plastic tube binding, and contamination, among others. Current solutions for such immunoassays employ lateral flow, lab on a chip and lab on a disc type devices. Because flow is in the laminar regime, diffusion is the primary mechanism behind target and sensor collisions and diffusion velocity depends on molecular weight. Instead of relying on diffusion, the device may employ fluid motion that significantly reduces NSB and an amount of time for such target and sensor collisions.

Figure 1B:
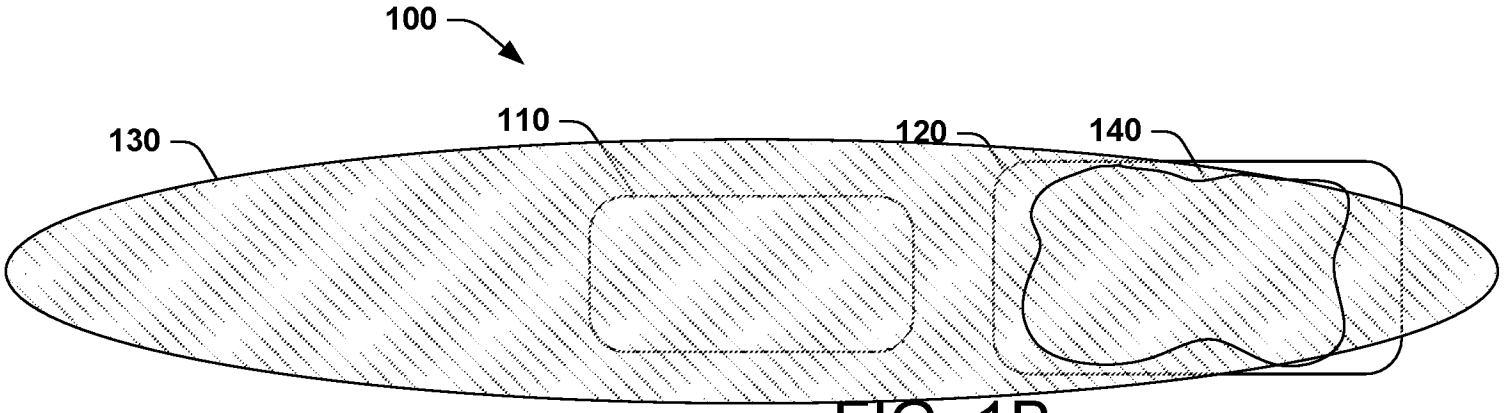

FIGS. 1A and 1B illustrate an example device 100 for generating fluid motion within a target fluid 140. FIG. 1A illustrates the device 100 including a fluid volume 115 in a liquid state and FIG. 1B illustrates the device 100 including the fluid volume 115 in a vaporized state 130 (e.g., a vapor bubble). In an example, the fluid volume 115 may be a micro-liter of fluid, in another example the fluid volume may be a nano-liter of fluid, and in yet another example the fluid volume may be a pico-liter of fluid. The device 100 may include a heating element 110 that heats the fluid volume 115 in response to a voltage V being applied to the heating element 110. In an example, a very small fraction of the fluid volume 115 (e.g., approximately <100 nm thick) interfaced with hot surface of the heating element 110 may be evaporated during actuation of the heating element 110. Although the example heating element 110 is illustrated as being rectangular in shape with rounded corners, in another example the heating element 110 may include right angle corners. Moreover, the heating element 110 may be formed in other shapes that include a square, circular, trapezoidal, omega-shape or any other shape on which the fluid volume 115 may be interfaced with.

Such heat may expand the fluid volume 115 and transform the fluid volume 115 from a liquid state into the vaporized state 130 to generate fluid motion, shear force, and/or fluid displacement, via high-pressure within the vapor state 130 within the target fluid 140 disposed within a molecular binding site 120 that is proximate to (e.g., less than approximately a millimeter) the heating element 110. The device 100 may generate such fluid motion, shear force, and/or fluid displacement of micro, nano and pico-liter scale volumes of the target fluid 140 via this fluid motion generated by the vaporized state 130 of the fluid volume 115. The vaporized state 130 of the fluid volume 115 may expand in a direction away from the heating element 110 to encompass the heating element 110 and at least a majority of the target fluid 140 within the molecular binding site 120. In another example, the vaporized state 130 may expand in a direction away from the heating element 110 without encompassing the molecular binding site 120 and may encompass the target fluid 140 within the molecular binding site 120. In yet another example, the vaporized state 130 may expand in a direction away from the heating element 110 to encompass both the heating element 110 and the target fluid 140. In yet another example, the vaporized state 130 may expand in a direction away from the heating element 110 to encompass a minority of the molecular binding site 120 and/or the target fluid 140. In yet another example (not shown), the molecular binding site 120 may not be proximate to the heating element 110 but may be located at a distance from the heating element 110. An expanding vaporized state 130 may causes fluid motion and shear force even at a distance (e.g., millimeters) away because of incompressibility of fluid. Terminate of application of the voltage V to the heating element 110 may result in the fluid volume 115 returning to the liquid state, reversal of a direction of the fluid motion toward the heating element 110, removal of the fluid motion from the fluid volume 115 and the target fluid 140 after the vaporized state 130 returns to the liquid state (e.g., until a next heating and cooling cycle), and contraction of the fluid volume 115 back on the heating element 110. In an example, the heating element 110 is a thermal ink-jetting (TIJ) resistor. In another example, the heating element 110 is an interdigitated resistor. In another example, the heating element 110 is a TIJ resistor array in a micro-reactor chamber.

The molecular binding site 120 may be disposed proximate to the heating element 110. The molecular binding site 120 may be in which a portion of the fluid volume 115 expands when the fluid volume 115 transforms from the liquid state into the vaporized state 130, the vaporized state 130 of the fluid volume 115 generating the fluid motion within the target fluid 140 that is disposed within the molecular binding site 120. Although the example molecular binding site 120 is illustrated as being rectangular in shape with rounded corners, in another example the molecular binding site 120 may include right angle corners. Moreover, the molecular binding site 120 may be formed in other shapes that include a square, circular, elliptical, trapezoidal, or any other shape within which the target fluid 140 may be disposed. Although the heating element 110 and the molecular binding site 120 are illustrated as being rectangular in shape with their short ends proximate to each other, in another example the heating element 110 and the molecular binding site 120 may be disposed with their longs ends proximate to each other. In yet another example, a short end of the heating element 110 or the molecular binding site 120 may be disposed proximate to a long end of another of the heating element 110 or the molecular binding site 120.

Figure 2A:
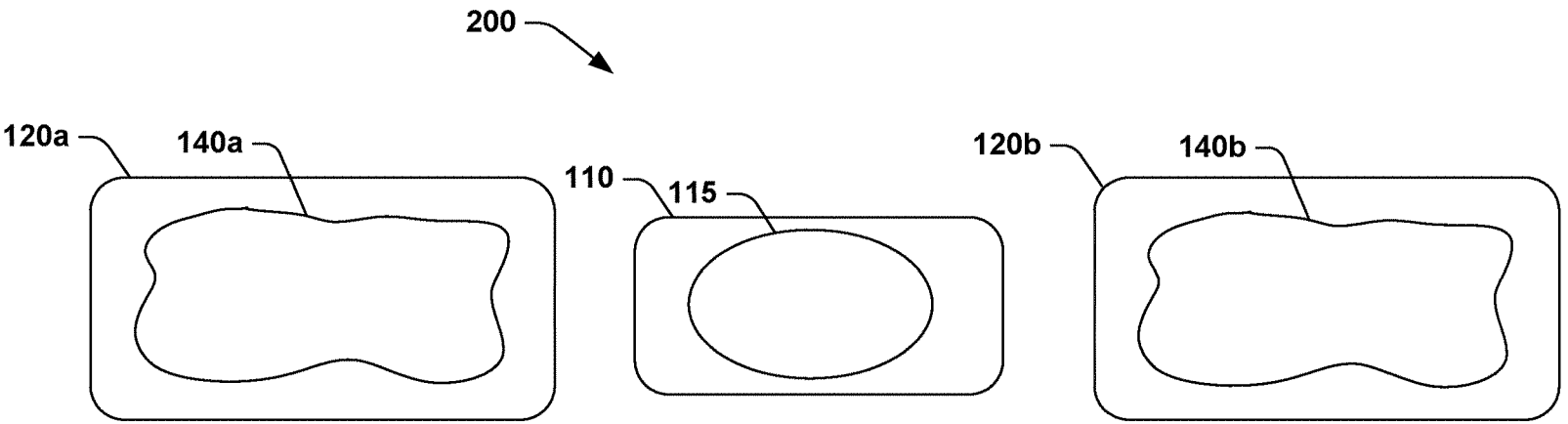
FIGS. 2A and 2B illustrate another example device for generating fluid motion within first and second target fluids, respectively.
Figure 2B:
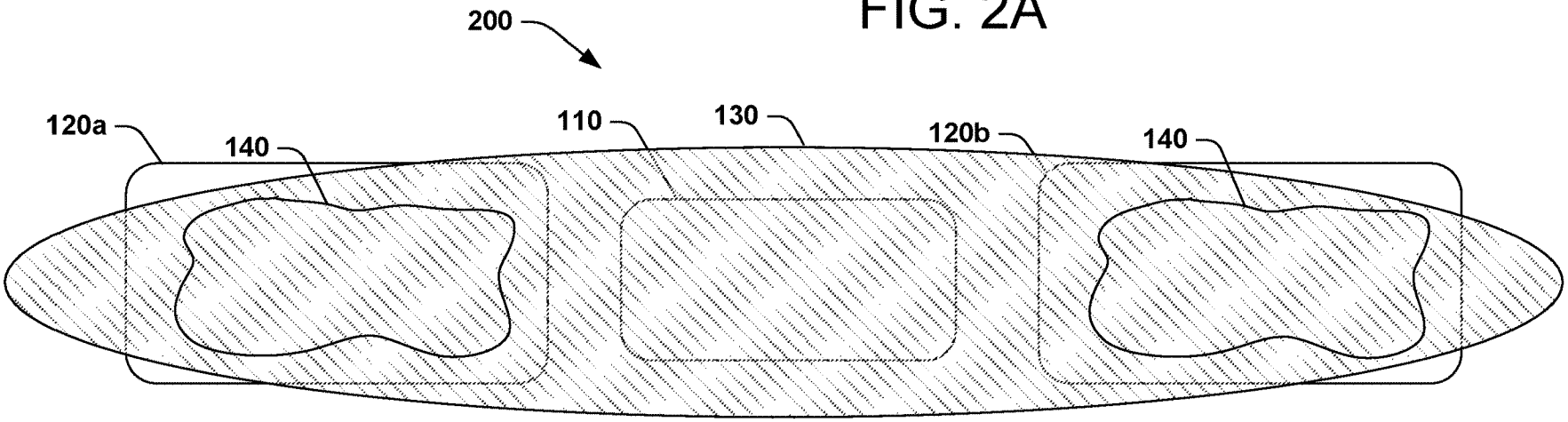

FIGS. 2A and 2B illustrate another example device 200 for generating fluid motion within first and second fluids 140*a* and 140*b*, respectively. FIG. 2A illustrates the device 200 including the fluid volume 115 in a liquid state and FIG. 2B illustrates the device 200 including the fluid volume 115 in a vaporized state 130 (e.g., a vapor bubble). In this example, the device 200 may include first and second molecular binding sites 120*a* and 120*b*, respectively. The first and second molecular binding sites 120*a* and 120*b* may be disposed proximate to and on opposite sides of the heating element 110, with the first and second molecular binding sites 120*a* and 120*b* and the heating element 110 forming an approximate straight line of elements. The first and second molecular binding sites 120*a* and 120*b* may have respective first and second fluids 140*a* and 140*b* disposed within. In an example, the first and second fluids 140*a* and 140*b* are a same fluid. In another example, the first and second fluids 140*a* and 140*b* are different fluids.

In this example, the heating element 110 may heat the fluid volume 115 to transform the fluid volume 115 from a liquid state into the vaporized state 130. The vaporized state 130 of the fluid volume 115 may expand in a direction away from the heating element 110 and encompass the heating element 110, and at least a majority of the first and second fluids 140*a* and 140*b* within the first and second molecular binding sites 120*a* and 120*b*, respectively. The fluid volume 115 may expand in a direction away from the heating element 110 when heated by the heating element 110 to generate fluid motion within the first and second fluids 140*a* and 140*b* that are disposed within the first and second molecular binding sites 120*a* and 120*b*. Thus, in this example the device 200 may utilize a single heating element 110 and a single fluid volume 115 to generate fluid motion within both of the first and second fluids 140*a* and 140*b* disposed within the first and second molecular binding sites 120*a* and 120*b*.

Figure 3A:
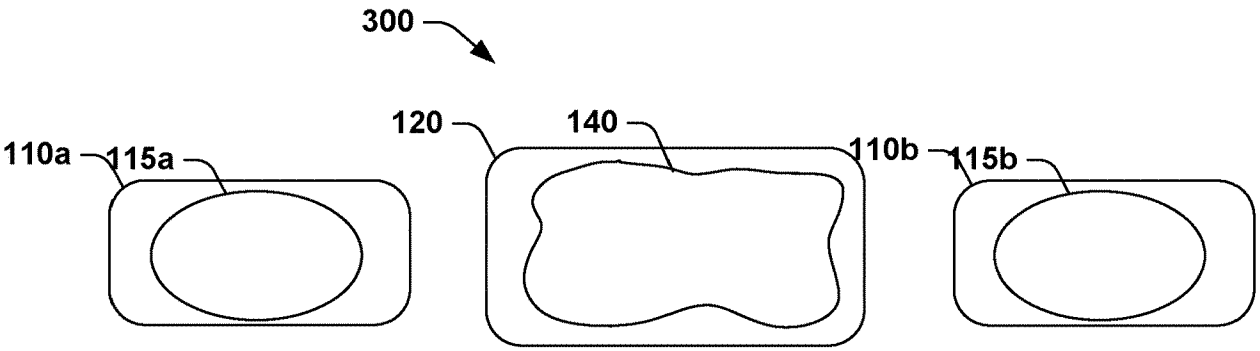
Figure 3A:
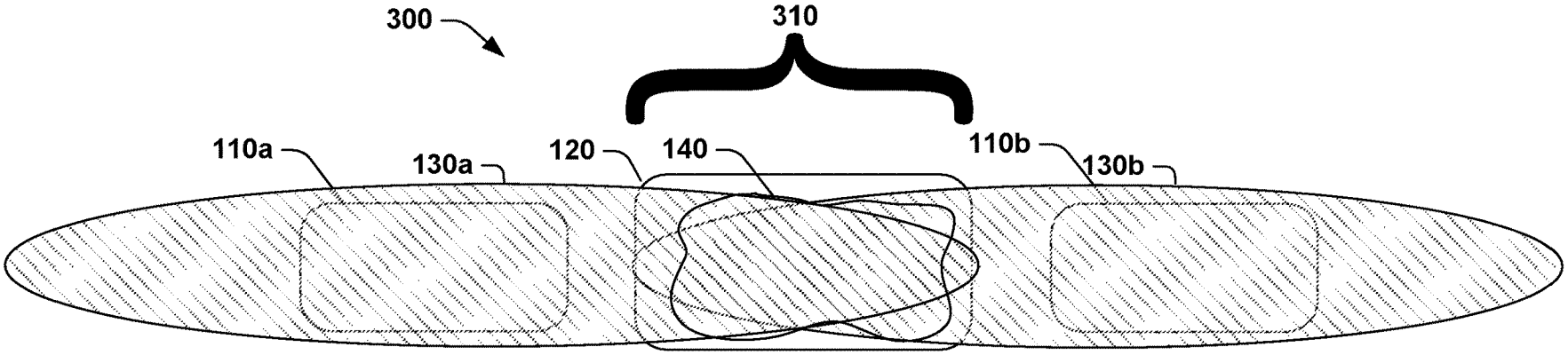

FIGS. 3A and 3B illustrate yet another example device 300 for generating fluid motion within the target fluid 140. FIG. 3A illustrates the device 300 including first and second fluid volumes 115*a* and 115*b* in a liquid state and FIG. 3B illustrates the device 300 including the first and second fluid volumes 115*a* and 115*b* in vaporized states 130*a* and 130*b* (e.g., a vapor bubble), respectively. In this example, the device 300 may include a single molecular binding site 120. First and second heating elements 110*a* and 110*b* may be disposed proximate to and on opposite sides of the molecular binding site 120, with the first and second heating elements 110*a* and 110*b* and the molecular binding site 120 forming an approximate straight line of elements. The first and second heating elements 110*a* and 110*b* may have respective first and second fluid volumes 115*a* and 115*b* disposed thereon. In an example, the first and second fluid volumes 115*a* and 115*b* are a same fluid.

In this example, the first and second heating elements 110*a* and 110*b* may heat their respective fluid volumes 115*a* and 115*b* to transform the first and second fluid volumes 115*a* and 115*b* from a liquid state into the first and second vaporized states 130*a* and 130*b*, respectively. The first and second vaporized states 130*a* and 130*b* of the respective first and second fluid volumes 115*a* and 115*b* may expand to encompass the first and second heating elements 110*a* and 110*b*, and at least a majority of the target fluid 140 within the molecular binding site 120. The first and second fluid volumes 115*a* and 115*b* may expand when heated by the first and second heating elements 110*a* and 110*b* to generate fluid motion within the target fluid 140 that is disposed within the molecular binding site 120. The first and second vaporized states 130*a* and 130*b* may overlap from opposite directions in a region 310 that approximately corresponds to the molecular binding site 120. In an example, the first and second vaporized states 130*a* and 130*b* may overlap in a region that is larger than the molecular binding site 120. In another example, the first and second vaporized states 130*a* and 130*b* may overlap in a region that is smaller than the molecular binding site 120. Thus, in this example the device 300 may utilize two heating elements, e.g., the first and second heating elements 110*a* and 110*b* and two fluid volumes, e.g., the first and second fluid volumes 115*a* and 115*b* to generate fluid motion within the single target fluid 140 disposed within the single molecular binding site 120. In an example, the voltage is applied to the first and second heating elements 110*a* and 110*b* at different times such that the first and second vaporized states 130*a* and 130*b* are generated at different times to generate fluid motion within the target fluid 140 that is disposed within the molecular binding site 120 at different times. This staggering of times of application of the voltage to the first and second heating elements 110*a* and 110*b* prevents the fluid motion from first and second vaporized states 130*a* and 130*b* from canceling each other out. In an alternate example, a voltage is applied to the first and second heating elements 110*a* and 110*b* simultaneously which may reduce fluid motion within the target fluid 140.

Figure 4:
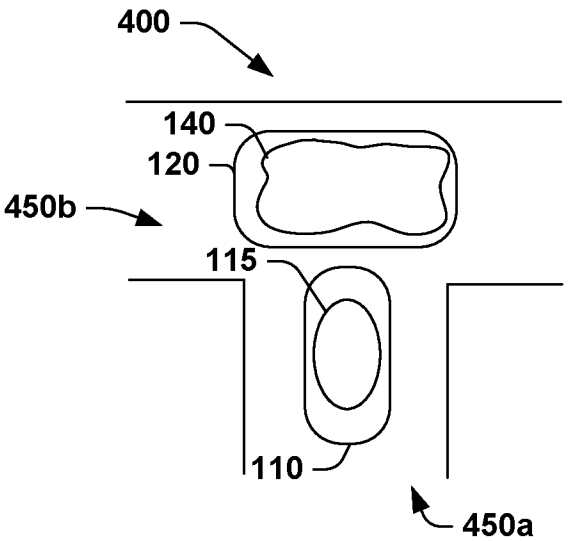
FIG. 4 illustrates yet another example device for generating fluid motion within the target fluid.

FIG. 4 illustrates yet another example device 400 for generating fluid motion within the target fluid 140. In this example, the heating element 110 and the molecular binding site 120 may be disposed in first and second channels 450*a* and 450*b* (e.g., capillary channels), respectively, that transport small volumes of fluid and fluid for the device 400. In this example, the first and second channels 450*a* and 450*b* may form a T shaped configuration, with the first channel 450*a* corresponding to the base of the T and the second channel 450*b* corresponding to the top of the T. The molecular binding site 120 may be disposed at an intersection between the first and second channels 450*a* and 450*b* and the heating element 110 may be disposed within the base of the T proximate to the intersection of the first and second channels 450*a* and 450*b*. The heating element 110 may heat the fluid volume 115 which vaporizes the fluid volume 115. The vaporized fluid volume (not shown) may expand to encompass a least a majority of the target fluid 140 within the molecular binding site 120, with the vaporized fluid volume generating fluid motion within the target fluid 140 disposed within the molecular binding site 120.

Figure 5:
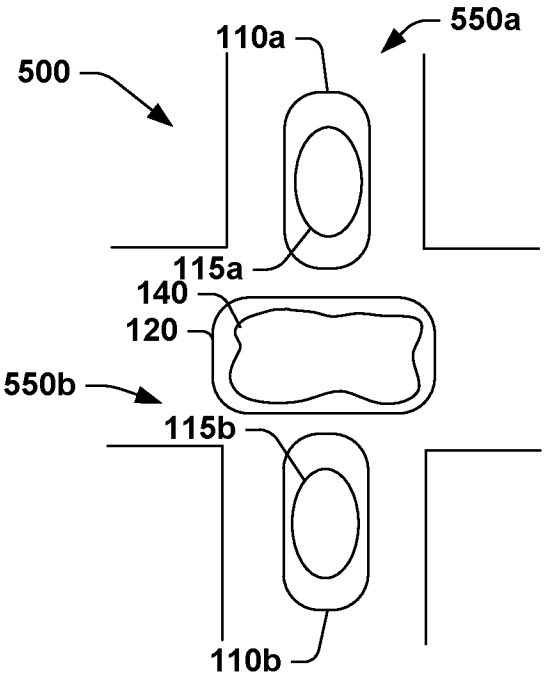
FIG. 5 illustrates yet another example device for generating fluid motion within the target fluid.

FIG. 5 illustrates yet another example device 500 for generating fluid motion within the target fluid 140. In this example, the device 500 may include first and second channels 550*a* and 550*b*, respectively, that form a +shaped configuration. The molecular binding site 120 may be disposed at an intersection of the first and second channels 550*a* and 550*b*, with short sides of the molecular binding site 120 being aligned with a length of the second channel 550*b* and long sides of the molecular binding site 120 being aligned with the first channel 550*a*. The first and second heating elements 110*a* and 110*b* may be disposed within the first channel 450*a* proximate to opposite sides of the molecular binding site 120. In an example, long sides of the molecular binding site 120 may be disposed proximate to the short sides of the first and second heating elements 110*a* and 110*b*. At least one fluid volume 115 may be interfaced with the first and second heating elements 110*a* and 110*b*. In the example illustrated, first and second fluid volumes 115*a* and 115*b*, respectively, are interfaced with the first and second heating elements 110*a* and 110*b*. The vaporized fluid volume (not shown) that results from heating the first and second fluid volumes 115*a* and 115*b* may expand to encompass a least a majority of the target fluid 140 within the molecular binding site 120, with the vaporized fluid volume generating fluid motion within the target fluid 140 disposed within the molecular binding site 120.

Figure 6:
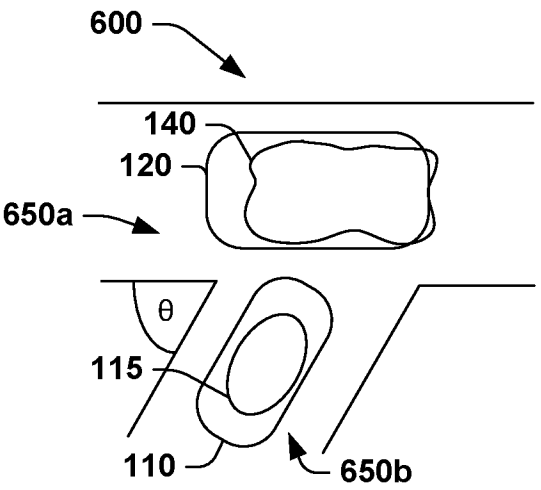
FIG. 6 illustrates yet another example device for generating fluid motion within the target fluid.

FIG. 6 illustrates yet another example device 600 for generating fluid motion within the target fluid 140. In this example, the device 600 may include first and second channels 650*a* and 650*b*, respectively, that form a y shaped configuration. The molecular binding site 120 may be disposed at an intersection of the first and second channels 650*a* and 650*b*, with short sides of the molecular binding site 120 being aligned with a length of the first channel 650*a* and a long side of the molecular binding site 120 being aligned with the second channel 650*b*. The first and second channels 650*a* and 650*b* may meet at an angle θ. In an example, the angle θ between the first and second channels 650*a* and 650*b* may be approximately 60 degrees. In other examples, the angle θ between the first and second channels 650*a* and 650*b* may be greater or less than 60 degrees. The heating element 110 may be disposed within the second channel 650*b* proximate to the molecular binding site 120. In an example, a long side of the molecular binding site 120 may be disposed proximate to a short side of the heating element 110. The fluid volume 115 may be interfaced with the heating element 110. The vaporized fluid volume (not shown) that results from heating the fluid volume 115 may expand to encompass a least a majority of the target fluid 140 within the molecular binding site 120, with the vaporized fluid volume 130 generating fluid motion within the target fluid 140 disposed within the molecular binding site 120.

Figure 7:
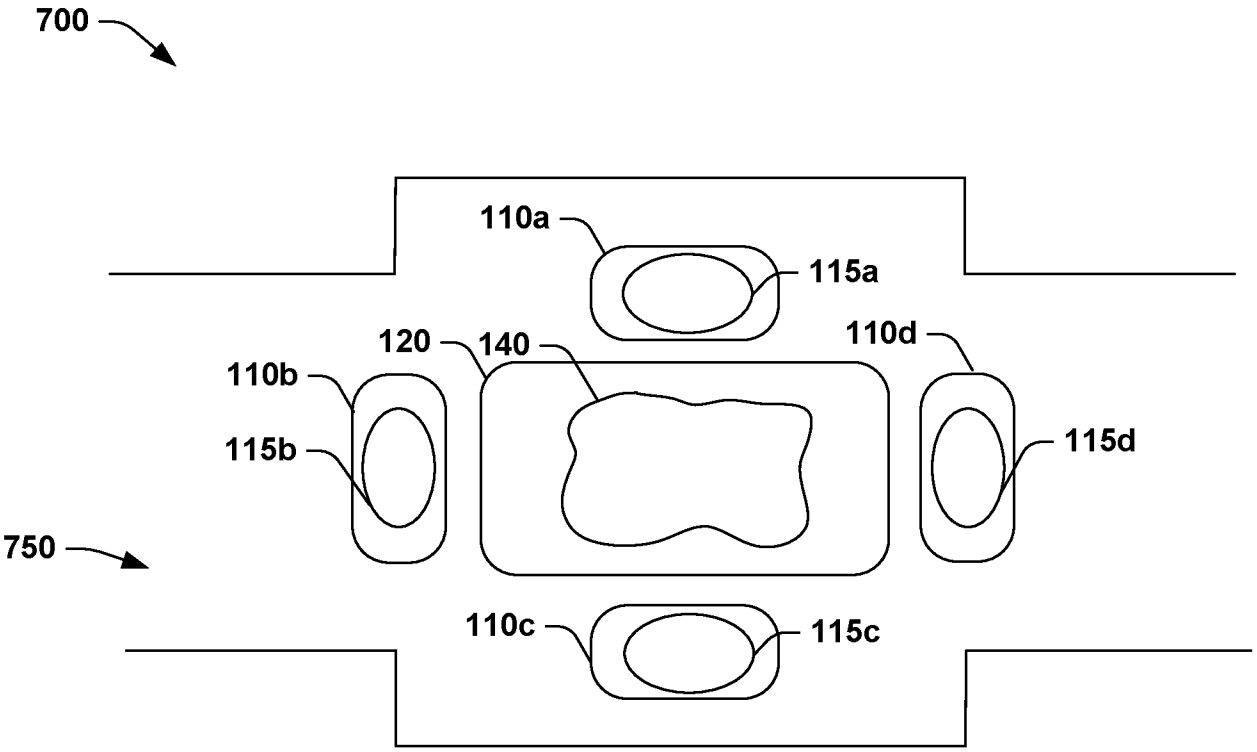
FIG. 7 illustrates yet another example device for generating fluid motion within the target fluid.

FIG. 7 illustrates yet another example device 700 for generating fluid motion within the target fluid 140. The device 700 may include first, second, third, and fourth heating elements 110*a-d*, respectively, and the molecular binding site 120. In this example, the device 700 may include a channel 750 that is greater in diameter in a portion of which the first, second, third, and fourth heating elements 110*a-b* and the molecular binding site 120 are disposed. A long side of each of the heating elements 110*a-b* may be aligned with a respective long side of the molecular binding site 120. At least one fluid volume 115 may be interfaced with the heating elements 110*a-d*. In this example, first, second, third, and fourth fluid volumes 115*a-d* are interfaced with the first, second, third, and fourth heating elements 110*a-d*. The vaporized fluid volumes (not shown) that results from heating the fluid volumes 115*a-d* may expand to encompass a least a majority of the target fluid 140 within the molecular binding site 120, with the vaporized fluid volumes generating fluid motion within the target fluid 140 disposed within the molecular binding site 120. In an example, one or more structures (not shown), such as pillars, may be positioned between the heating element 110 and the molecular binding site 120 to direct the vaporized state 130 of the fluid volume 115 over the molecular binding site 120.

In another example (not shown), a central heating element 110 may be surrounded by a first, second, third and fourth molecular binding sites 120 disposed along outer edges of the central heating element 110. In this example, a fluid volume 115 interfaced with the central heating element 110 may vaporize to generate the vaporized fluid volume 130. This vaporized fluid volume 130 may generate fluid motion within the first, second, third and fourth molecular binding sites 120 surrounding the central heating element 110. Thus, in this example a single heating element 110 may generate fluid motion within four target fluids 140 disposed within the four molecular binding sites 120 surrounding the central heating element 110.

Figure 8:
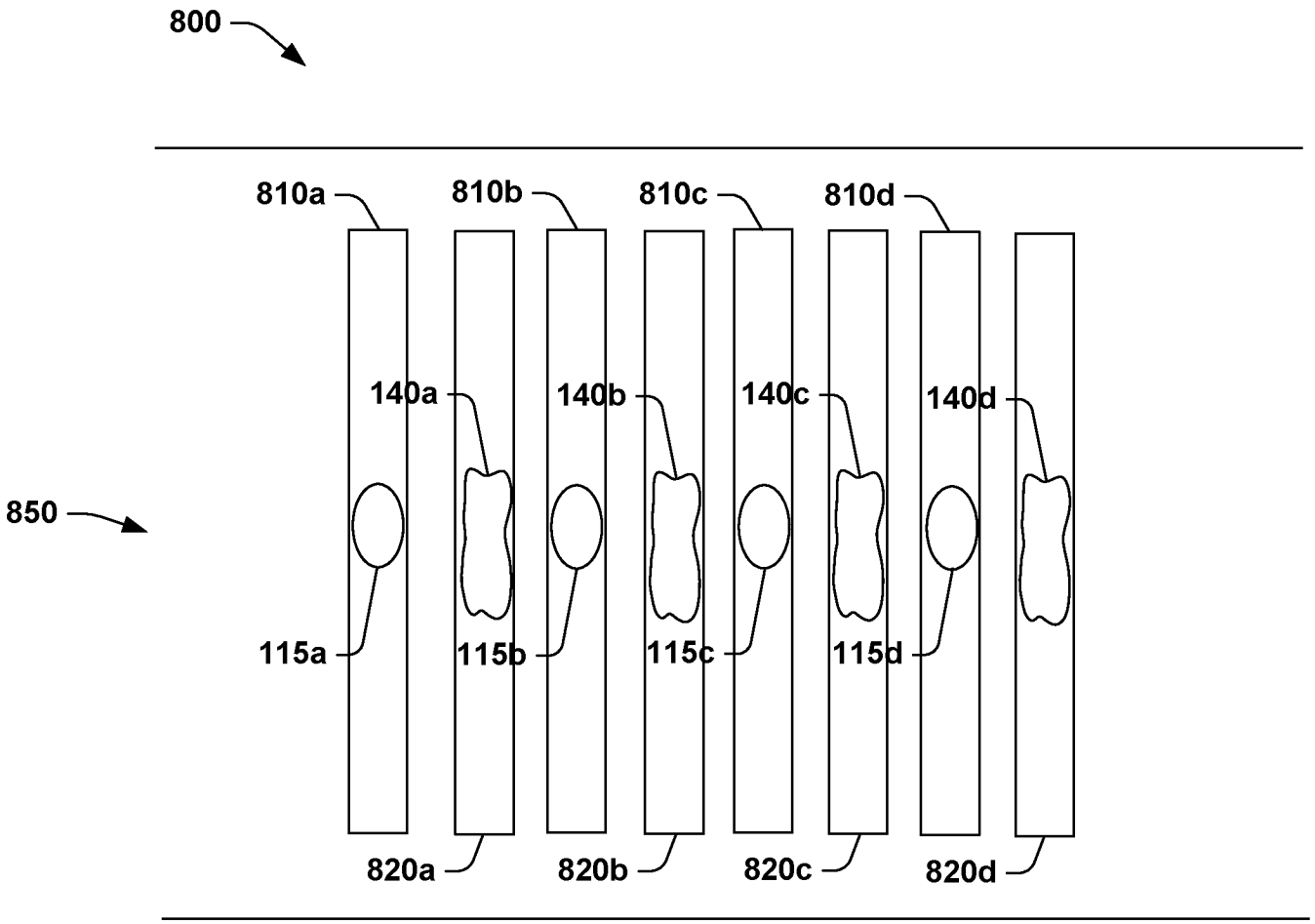
FIG. 8 illustrates yet another example device for generating fluid motion within the target fluid.

FIG. 8 illustrates yet another example device 800 for generating fluid motion within the target fluid 140. The device 800 may include first, second, third, and fourth heating elements 810*a-d*, respectively, and first, second, third, and fourth molecular binding sites 820*a-d*, respectively. The first, second, third, and fourth heating elements 810*a-d* and the first, second, third, and fourth molecular binding sites 820*a-d* may be disposed within a channel 850, with their shorter ends aligning with walls of the channel 850. The device 800 may include alternating heating elements 810*a-d* and molecular binding sites 820*a-d*. The device 800 may include one or more fluid volumes 115 and one or more fluids 140. In this example, first, second, third, and fourth fluid volumes 115*a-d* are interfaced with the first, second, third, and fourth heating elements 110*a-d*. Likewise, first, second, third, and fourth fluids 140*a-d* are disposed within molecular binding sites 820*a-d*. Vaporized fluid volumes (not shown) that results from heating the fluid volumes 115*a-d* may expand to encompass a least a majority of the fluids 140*a-d* within the molecular binding sites 120*a-d*, with the vaporized fluid volumes generating fluid motion within the fluids 140*a-d* disposed within the molecular binding sites 120*a-d*. In an example, micro-fabrication techniques (e.g., photolithography) may be used for multiplexing of and creation of complex microarrays of heating elements 110/810 and molecular binding sites 120/820, such as those illustrated in FIGS. 1-8.

Figure 9:
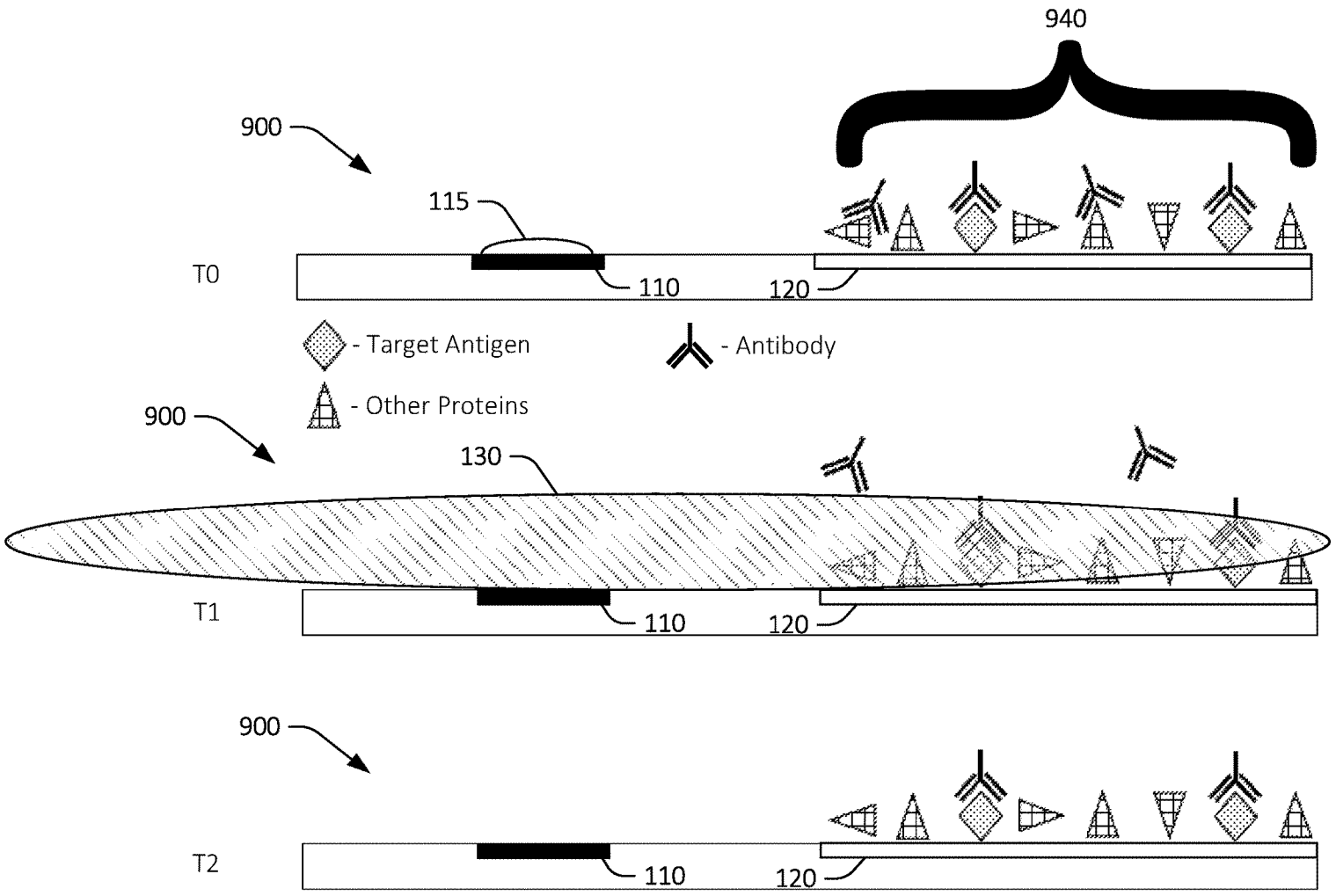
FIG. 9 illustrates an example device for generating fluid motion within another target fluid.

FIG. 9 illustrates an example device 900 for generating fluid motion within another fluid 940. In an example, the device 900 may be comprised of at least one of the devices 100-800 and may be utilized for immunoassay in which the fluid volume 130 may be aqueous solution and the target fluid 140 may be the fluid 940 that may include an analyte and a reagent. The device 900 may disrupt non-specific binding which is a common problem in biological samples.

At time T0, the fluid volume 130 may be interfaced with the heating element 110 and the fluid 940 may be disposed within the molecular binding site 120. In an example, the molecular binding site 120 may be coated with streptavidin, which is resistant to organic solvents, denaturants, detergents, proteolytic enzymes and extremes of temperature and pH. In yet another example, the molecular binding site 120 may include solid phase posts, such hapten conjugate (small molecule), a capture antibody, and a sample analyte. At time T0, antibodies are illustrated as binding to both target antigens and other proteins. At a time between T0 and T1 (not shown), the voltage V is applied to the heating element 110 that generates heat within the fluid volume 115, such heat may transform the fluid volume 115 from the liquid state into the vaporized state 130 to generate shear force and fluid motion within the fluid 940 disposed within the molecular binding site 120, illustrated at time T1.

Such fluid motion generated by the vaporized state 130 of the fluid volume 115 may dislodge the antibodies that are bound to the other proteins and may allow the antibodies to remain bound to the target antigens. The antibodies may become dislodged from the other proteins and remain bound to the target antigens because the antibodies have weaker binding energies with the other proteins than the energies that bind the antibodies to the target antigens. This application of the voltage V to the heating element 110 may be performed repeatedly or pulsed for short durations (e.g., less than approximately a microsecond), to assist in such dislodging of the antibodies from the other proteins. This pulsing may be repeated a number of time, with the number being dependent upon a desired effect on the target fluid 140. This repeated pulsing may produce back-and-forth fluid motion and back-and forth shear force that corresponds to the expansion and contractions of the fluid volume 115. In an example, this repeated pulsing reduced NSB within a species. At a time between T1 and T2 (not shown), a wash process may be used to remove the dislodged antibodies. At time T2, the number of antibodies that remain bound to the other proteins may be significantly reduced, resulting in an improved capture of antibodies.

The molecular binding site 120 may include a detector to analyze the target fluid 140. For example, the molecular binding site 120 may include an enzyme-linked immunosorbent assay (ELISA) detector that detects the antibodies within the fluid 940. The devices 100-900 improve mixing and interaction of the analyte and the antibodies for diluted and undiluted samples. The devices 100-900 may be utilized for various enzyme linked immunoassay formats, such as direct, indirect, sandwich, competitive, or any other enzyme linked immunoassay format. In an example, the devices 100-900 may be utilized to capture DNA from a solution as a concentration step before amplification. In another example, the devices 100-900 may be utilized to concentrate cells by immobilizing them to a surface, which reduced potential for variation of coated beads and wells. In yet another example, the devices 100-900 may be utilized to mix sticky para-magnetic particles that are associated with lower assay sensitivity. The devices 100-900 may provide for a consistent mixing scheme under and over reagent mixing that can cause a problem with assay sensitivity. In yet another example, the devices 100-900 may utilize multiplexing to perform multi-process steps and cycles.

Figure 10:
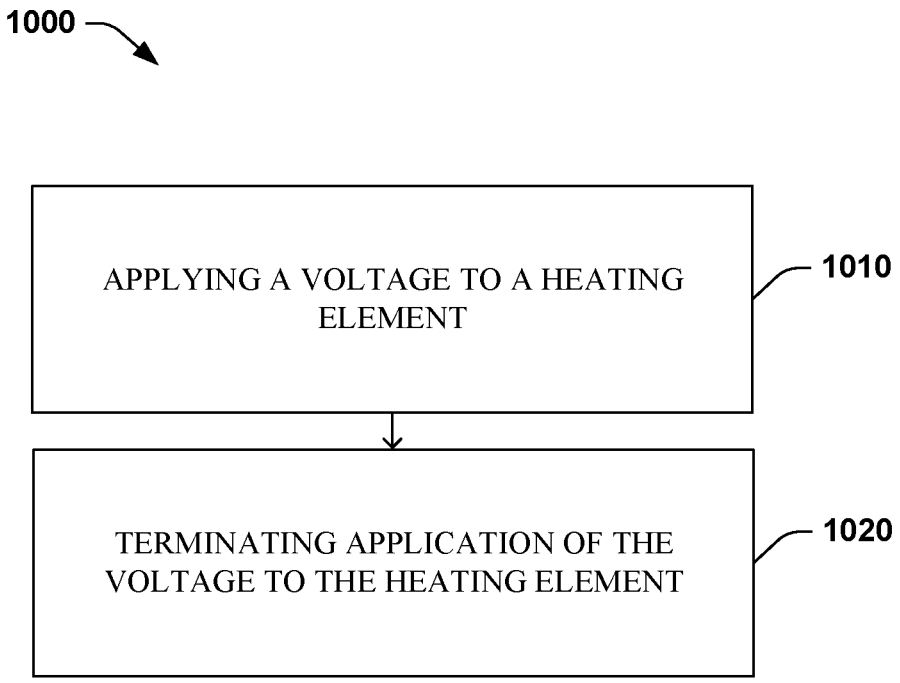
FIG. 10 illustrates an example method for generating fluid motion within the target fluid.

In view of the foregoing structural and functional features described above, a method in accordance with various aspects of the present disclosure will be better appreciated with reference to FIG. 10. While, for purposes of clarity, the method of FIG. 10 is shown and described as executing serially, it is to be understood and appreciated that the present disclosure is not limited by the illustrated order, as some aspects may, in accordance with the present disclosure, occur in different orders and/or concurrently with other aspects from that shown and described herein. Moreover, not all illustrated features may be required to implement a method in accordance with an aspect of the present disclosure.

FIG. 10 illustrates an example method 1000 for generating fluid motion within the target fluid 140. At 1010, the method 1000 may include application of the voltage V to a heating element 110 to heat the fluid volume 115 interfaced with the heating element 110. The heat may transform the fluid volume 115 from a liquid state into a vaporized state 130 that may generate fluid motion within the fluid volume 115, expand the fluid volume 115 into the molecular binding site 120 proximate to the heating element 110, and generate fluid motion within the target fluid 140 that is disposed within the molecular binding site 120.

At 1020, the method 1000 may terminate application of the voltage to the heating element 110. Such the termination may result in the fluid volume 115 returning to the liquid state, reversal of a direction of the fluid motion toward the heating element 110, reversal of a direction of the fluid motion toward the heating element 110, removal of the fluid motion from the fluid volume 115 and the target fluid 140, and contraction of the fluid volume 115 back on the heating element 110.

What have been described above are examples of the disclosure. It is, of course, not possible to describe every conceivable combination of components or method for purposes of describing the disclosure, but one of ordinary skill in the art will recognize that many further combinations and permutations of the disclosure are possible. Accordingly, the disclosure is intended to embrace all such alterations, modifications, and variations that fall within the scope of this application, including the appended claims.

The preceding description has been presented to illustrate and describe examples of the principles described. This description is not intended to be exhaustive or to limit these principles to any precise form disclosed. Many modifications and variations are possible in light of the above teaching. What have been described above are examples. It is, of course, not possible to describe every conceivable combination of components or methods, but one of ordinary skill in the art will recognize that many further combinations and permutations are possible. Accordingly, the invention is intended to embrace all such alterations, modifications, and variations that fall within the scope of this application, including the appended claims. Additionally, where the disclosure or claims recite "a," "an," "a first," or "another" element, or the equivalent thereof, it should be interpreted to include one or more than one such element, neither requiring nor excluding two or more such elements. As used herein, the term "includes" means includes but not limited to, and the term "including" means including but not limited to. The term "based on" means based at least in part on.

What is claimed is:

1. A device, comprising:

a heating element configured to heat a fluid volume, interfaced with the heating element, in response to a voltage being applied to the heating element, the heat transforming the fluid volume from a liquid state into a vaporized state to generate fluid motion within the fluid volume; and a molecular binding site, disposed proximate to the heating element, in which a portion of the fluid volume expands when the fluid volume transforms from the liquid state into the vaporized state, the vaporized state of the fluid volume generating the fluid motion within a target fluid that is disposed within the molecular binding site;

wherein the molecular binding site is a first molecular binding site and the target fluid is a first target fluid, the device further comprising a second molecular binding site on an opposite side of heating element from the first molecular binding site, wherein the fluid motion generated within the fluid volume generates fluid motion within a second target fluid within the second molecular binding site.

2. The device of claim 1, wherein the heating element is a thermal ink-jetting (TIJ) resistor.

3. The device of claim 1, wherein the heating element is an interdigitated resistor.

4. The device of claim 1, wherein the fluid volume is aqueous solution and the target fluid is comprised of an analyte and a reagent.

5. The device of claim 1, wherein the heating element is a first heating element and the fluid volume is a first fluid volume, the device further comprising a second heating element on the opposite side of the molecular binding site from the first heating element, the second heating element heating a second fluid volume interfaced with the second heating element in response to the voltage being applied to the second heating element, the heat transforming the second fluid volume from a liquid state into a vaporized state and generating fluid motion within the second fluid volume, a portion of the vaporized state of the first and second fluid volumes generating fluid motion within the target fluid that is disposed within the molecular binding site, wherein the voltage is applied to the first and second heating elements at different times.

6. The device of claim 1, further comprising a capillary channel including the heating element and the molecular binding site, the capillary channel transporting the fluid volume between different portions of the device.

7. The device of claim 1, wherein the molecular binding site includes an enzyme-linked immunosorbent assay (ELISA) detector to detect antibodies within the target fluid and wherein the fluid motion reduces non-specific binding within the target fluid.

8. A method, comprising:

applying a voltage to a heating element to heat a fluid volume interfaced with the heating element, the heat transforming the fluid volume from a liquid state into a vaporized state, generating fluid motion within the fluid volume, expanding the fluid volume into a molecular binding site proximate to the heating element, and generating fluid motion within a target fluid that is disposed within the molecular binding site; and terminating application of the voltage to the heating element, the terminating resulting in the fluid volume returning to the liquid state, reversal of a direction of the fluid motion toward the heating element, removal of the fluid motion from the fluid volume and the target fluid, and contraction of the fluid volume back on the heating element;

wherein the molecular binding site is a first molecular binding site and the target fluid is a first target fluid, the method further comprising disposing the second molecular binding site on an opposite side of heating element from the first molecular binding site, wherein the fluid motion generated within the fluid volume generates fluid motion within a second target fluid disposed within the second molecular binding site.

9. The method of claim 8, wherein the heating element is a first heating element and the fluid volume is a first fluid volume, the method further comprising applying the voltage to a second heating element on the opposite side of the molecular binding site from the first heating element to heat the second fluid volume interfaced with the second heating element, the heat transforming a second fluid volume from a liquid state into a vaporized state and generating fluid motion within the second fluid volume, wherein a portion of the first and second fluid volumes generate fluid motion within the target fluid that is disposed within the molecular binding site, wherein the voltage is applied to the first and second heating elements at different times.

10. The method of claim 8, further comprising disposing the heating element and the molecular binding site within a capillary channel that transports the fluid volume between different portions of a device performing the method.

11. A device, comprising:

a heating element configured to heat a volume of aqueous solution, interfaced with the heating element, in response to a voltage being applied to the heating element, the heat transforming the volume of aqueous solution from a liquid state into a vaporized state to generate fluid motion within a target fluid that is comprised of an analyte and a reagent; and a molecular binding site, disposed proximate to the heating element, in which a portion of the volume of aqueous solution expands when the fluid volume transforms from the liquid state into the vaporized state, the vaporized state of the volume of aqueous solution generating the fluid motion within target fluid that is disposed within the molecular binding site;

wherein the molecular binding site is a first molecular binding site and the target fluid is a first target fluid, the device further comprising a second molecular binding site on an opposite side of heating element from the first molecular binding site, wherein the vaporized state of the volume of aqueous solution generates fluid motion within a second target fluid within the second molecular binding site.

12. The device of claim 11, further comprising a capillary channel including the heating element and the molecular binding site, the capillary channel transporting the fluid volume between different portions of the device.

13. The device of claim 11, wherein the molecular binding site includes an enzyme-linked immunosorbent assay (ELISA) detector to detect antibodies within the fluid and wherein the fluid motion reduces non-specific binding within the target fluid.

* * * * *